US008745797B2

(12) United States Patent
Misaki et al.

(10) Patent No.: US 8,745,797 B2
(45) Date of Patent: Jun. 10, 2014

(54) MATTRESS

(71) Applicants: Tokai Rubber Industries, Ltd., Aichi (JP); Kyushu University, National University Corporation, Fukuoka (JP)

(72) Inventors: Akitsugu Misaki, Aichi (JP); Shin-ichiro Takasugi, Fukuoka (JP); Shuji Fukugawa, Fukuoka (JP); Mika Wada, Fukuoka (JP); Kiyoe Harada, Fukuoka (JP); Keiko Miyazaki, Fukuoka (JP); Yukiko Tachibana, Fukuoka (JP); Yukihide Iwamoto, Fukuoka (JP)

(73) Assignees: Tokai Rubber Industries, Ltd., Aichi (JP); Kyushu University, National University Corporation, Fukuoka (JP)

( * ) Notice: Subject to any disclaimer, the term of this patent is extended or adjusted under 35 U.S.C. 154(b) by 0 days.

(21) Appl. No.: 13/910,470

(22) Filed: Jun. 5, 2013

(65) Prior Publication Data

US 2013/0263379 A1 Oct. 10, 2013

Related U.S. Application Data

(63) Continuation of application No. PCT/JP2012/004816, filed on Jul. 27, 2012.

(30) Foreign Application Priority Data

Jul. 28, 2011 (JP) ..... 2011-165305

(51) Int. Cl.
*A47C 27/08* (2006.01)

(52) U.S. Cl.
USPC ..... 5/710; 5/713

(58) Field of Classification Search
USPC ..... 5/706, 644, 710–713, 655.3
See application file for complete search history.

(56) References Cited

U.S. PATENT DOCUMENTS 3,879,779 A * 4/1975 Jewett ..... 114/343
4,120,061 A * 10/1978 Clark ..... 5/710

(Continued)

FOREIGN PATENT DOCUMENTS

EP 1543748 6/2005
JP 2615206 5/1997

(Continued)

OTHER PUBLICATIONS

International Search Report dated Aug. 21, 2012 with English language translation.

(Continued)

*Primary Examiner* — Fredrick Conley
(74) *Attorney, Agent, or Firm* — Greenblum & Bernstein P.L.C.

(57) ABSTRACT

The objective of the present invention is to provide a mattress including a plurality of cells provided on a body pressure working surface of a substrate that supports a human body, and a pressure control means that changes a setting of a height of each cell by adjusting a pressure in a fluid chamber formed within the cell. An elastic cushion layer is provided on a body pressure working surface of the cells, and a constricted portion is formed in a middle in the height of the each cell so that the body pressure working surface of the cell is allowed to tilt following deformation of the cushion layer as a result of the cells' precession-deformation at the constricted portion.

12 Claims, 9 Drawing Sheets

(56) References Cited

U.S. PATENT DOCUMENTS

| | | | |
|---|---|---|---|
| 6,073,290 | A | 6/2000 | Miller |
| 6,302,988 | B1 | 10/2001 | Miller |
| 7,536,739 | B2 | 5/2009 | Poulos |
| 7,596,823 | B2 | 10/2009 | Friedrichs |
| 2003/0020593 | A1 | 1/2003 | Ito et al. |
| 2006/0049678 | A1 | 3/2006 | Kern et al. |
| 2007/0094806 | A1 | 5/2007 | Beretta |
| 2011/0308019 | A1 | 12/2011 | Terawaki et al. |

FOREIGN PATENT DOCUMENTS

| | | |
|---|---|---|
| JP | 11-004856 | 1/1999 |
| JP | 2000-189472 | 7/2000 |
| JP | 2003-042866 | 2/2003 |
| JP | 2005-218731 | 8/2005 |
| JP | 2007/144007 | 6/2007 |
| JP | 2008-200084 | 9/2008 |
| JP | 2010-125280 | 6/2010 |
| JP | 4494818 | 6/2010 |
| JP | 2011-075322 | 4/2011 |
| WO | 2011/006093 | 1/2011 |

OTHER PUBLICATIONS

English language translation of IPRP dated Jan. 28, 2014.
E.P.O. Search Report, mail date is Mar. 10, 2014.

* cited by examiner

MATTRESS

INCORPORATED BY REFERENCE

The disclosure of Japanese Patent Application No. 2011-165305 filed on Jul. 28, 2011 including the specification, drawings and abstract is incorporated herein by reference in its entirety. This is a Continuation of International Application No. PCT/JP2012/004816 filed on Jul. 27, 2012.

BACKGROUND OF THE INVENTION

1. Field of the Invention

The present invention relates to a mattress used for a nursing care bed and the like.

2. Description of the Related Art

Conventionally, in a part of a bed for supporting the human body, a mattress with a cushion function has been used to improve the comfort of sleeping by elastically supporting the human body. This type of mattress is made of elastic materials such as urethane foam, for example.

When a user, who has a difficulty in turning over in bed, continues to use a conventional mattress for a long period of time, reaction forces against the body pressure (due to the body weight) are exerted continuously on the user's body part, thus posing a risk of developing bedsores caused by interrupted blood circulation and the like. Therefore, in order to prevent bedsores from developing, a movable mattress is proposed that can disperse the reaction forces substantially applied against the body pressure of the user, by means of changing the working points of the user's body pressure through the use of fluid pressure. In other words, such a mattress has its working portion of the body pressure (that supports the human body) composed of multiple cells, wherein the cell heights are set to change at a prescribed timing by means of drawing fluid such as outside air into a fluid chamber of each cell and exhausting it therefrom to adjust the inner pressure of the cells. This causes the cells that substantially support the user's body and those that do not to interchange with each other at a prescribed timing, thus preventing the user's body parts from being compressed for a long time due to the body pressure. An example of such a mattress is explained in Publication of Japanese Patent No. 4494818.

However, in case of the movable mattress described in Japanese Patent No. 4494818 wherein the body supporting portion can be varied by periodical expansion and contraction of the cells, the user may be shaken on the mattress more than necessary to experience a discomfort feeling similar to sea sickness, which can cause nausea and vomiting, and that is why improved sleeping comfort has been sought for.

Also, Publication of Japanese Patent No. 2615206 describes a mattress that can bring its surface configuration in line with the body contour by controlling the cell heights for the purpose of dispersing the body pressure. It was considered that, using such a mattress, the user can prevent concentration of loads from working on the bulging parts of the user's body (e.g. buttocks), and at the same time, can avoid nausea and vomiting caused by a feeling of shaking.

However, the mattress described in Japanese Patent No. 2615206 is provided with a support member that connects cells with each other in order to keep each cell in a given direction, and deformation of the cells was too restricted to an approximately vertical direction to provide enough dispersion of the body pressure. In other words, the structure of the mattress described in Japanese Patent No. 2615206 had a risk of developing bedsores by concentrated body pressure around the contact portion between the outer periphery of the cells and the human body, for example, due to the surface configuration of the mattress capable of following the body contour having a curvy and smooth shape only in a series of steps.

In addition, deformation and displacement of the mattress surface in the planar direction is restricted by the mutual positioning of the cells by the support member in the planar direction of the mattress, which generates frictions between the user and the mattress surface when the user moves his body in the planar direction of the mattress, thus posing a risk of developing bedsores.

SUMMARY OF THE INVENTION

The present invention has been developed in view of the background described above, and it is an object of the present invention to provide a mattress with a novel structure whereby the usability of the mattress is improved, while the prevention of bedsores is effectively achieved by means of dispersed body pressure.

A first mode of the present invention provides a mattress including: a plurality of cells arranged on a body pressure working surface of a substrate that supports a human body; a pressure control means that changes a setting of a height of each cell by adjusting a pressure in a fluid chamber formed within the cell; an elastic cushion layer provided on a body pressure working surface of the cells; and a constricted portion formed in a middle in the height of the each cell so that the body pressure working surface of the cell is configured to be tilted following deformation of the cushion layer as a result of the cells' precession-deformation at the constricted portion.

Using the mattress with the structure according to the first aspect, when the cushion layer is subjected to depression deformation imposed by the user's body pressure, a force in the planar direction is applied to the upper surface of the cells, which is the body pressure working surface, due to frictions and the like against the cushion layer. In that case, because of the constricted portion formed in the cells, the upper part of the constricted portion of the cells gets tilted relative to the lower part thereof. In other words, the upper surface of the cells gets tilted by the precession-deformation (precession tilt) at the constricted portion thereof. This allows the cushion layer to be supported by the cells over a wide area with the upper surface of the cells in line with the concave form of the cushion layer, while being supported by the cells at an almost constant interval with no bias. Therefore, the user's body is supported over a wide area with approximate evenness, thus dispersing the user's body pressure and preventing bedsores caused by concentrated body pressure from developing as well as achieving the comfort of sleeping.

Also, because of the formation of the constricted portion in each cell, the maximum height of the cell of the pressurized fluid chamber can be made larger without increasing the projected area of the cell so that the stroke of each cell is kept large enough, thus achieving dispersion of body pressure by controlling the cell height and avoiding bottoming of the cells.

The upper surface of each cell is allowed to undergo a relative displacement in the planar direction by the deformation thereof at its constricted portion. This causes the cushion layer to displace itself to follow the user's body according to the displacement on the cell's upper surface when the user moves his body in the planar direction of the cushion layer. Therefore, frictions between the user's body and the cushion layer as well as bedsores caused thereby are prevented from developing.

Also, since the cushion layer is provided on top of a plurality of cells independent from each other, the user is supported by a continuous surface of the cushion layer without feeling a gap between the cells. Therefore, it is now possible to remove the unstable feeling given by the support surface (body pressure working surface) owing to the adoption of cells that are allowed to tilt independently from each other, thus providing the comfort of sleeping.

A second mode of the present invention provides the mattress according to the first mode, wherein a bottom center portion of the cells are supported by the substrate and the cells are allowed to tilt against the substrate.

According to the second aspect, it is possible to increase the degree of freedom of the tilt angle on the cell's upper surface by the precession tilt of the upper part of the constricted portion of the cells relative to the lower part that is tilted against the substrate. Therefore, even when the cushion layer is partially subjected to substantial depression deformation, the upper surface of the cells can follow the configuration of the cushion layer so as to achieve dispersion of the body pressure and the sleeping comfort.

Especially because the cells are supported by the substrate at each bottom center, the tilting of the cells is allowed equally in any direction, and the followability of the cell's upper surface is stably exerted regardless of the location of the depression deformation of the cushion layer.

A third mode of the present invention is the mattress according to the first or second mode, wherein the pressure control means is able to change the setting individually about the heights of the plurality of cells.

According to the third aspect, the cell heights can accurately follow the partial depression deformation of the cushion layer to effectively achieve dispersion of the body pressure and the comfort of sleeping by closely following up with the body surface configuration.

Also, since the air pressure of each cell is controlled independently, fluid does not flow between the cells, and even if one cell is pressed hard, there is no way that fluid in one cell flows into another. Thus, the unstable feeling evoked by the flow of fluid, a problem likely to occur with conventional mattresses that use fluid pressure, is removed, thus stably providing the comfort of sleeping.

A fourth mode of the present invention is the mattress according to any one of the first to third modes, wherein each of the cells has a rectangular shape with rounded corners as seen in a height direction projection.

According to the fourth aspect, the area of the upper surface of the cell can be maintained large enough to support the cushion layer as well as user's body over a wider area so that dispersion of body pressure and improvement in the sleeping comfort are effectively achieved. Moreover, due to the rounded corner of the rectangle, when the body pressure is applied to expanding cells, possible damages to the corners under concentrated stresses can be avoided, thus improving the durability of the mattress.

A fifth mode of the present invention is the mattress according to any one of the first to fourth modes, wherein an elastic framework is provided and the plurality of cells are arranged inside the framework.

According to the fifth aspect, each cell arranged by the framework along the outmost periphery is prevented from falling down outward so as to stably establish itself on the substrate. Moreover, due to the elasticity of the framework, damages in the incidents where users hit their arms against the framework can be avoided, while flexural deformation of the mattress is not inhibited by the framework during head-up tilting, for example.

A sixth mode of the present invention is the mattress according to any one of the first to fifth modes, wherein the cushion layer is structured in two layers, which is a first cushion layer and a second cushion layer stuck together, and a body pressure sensor for measuring body weight is arranged between the first and second cushion layers.

According to the sixth aspect, the cell height can be set according to the individual differences in the body pressure distribution based on the physical characteristic of the users and changes in the bodily positions, for example, by adjusting the pressure within the fluid chamber by the pressure control means based on the detection results of the body pressure sensor, thus effectively achieving dispersion of body pressure and the like. In addition, since the elastic cushion layer is structured in two-tiers comprising the first and second cushion layers with a body pressure sensor arranged between them, the adverse effect on the comfort of sleeping is restricted, while the body pressure sensor is protected by the cushion layer, thus improving the durability of the mattress.

According to the present invention, the cushion layer is provided on the body pressure working surface of each cell having a constricted portion, and the body pressure working surface of the cell gets tilted in line with the configuration of the cushion layer that undergoes depression deformation by the cell's precession tilt at the constricted portion in consequence of the deformation of the cushion layer. This causes the body pressure working surface of the cell to be tilted in accordance with the contour of the user's body supported by the cells over a wide area, which makes it possible to prevent bedsores by means of dispersing the body pressure. Furthermore, the provision of the cushion layer alleviates the unstable feeling created by the support surface that allows the cells to have precession displacements, enabling to provide excellent sleeping comfort.

BRIEF DESCRIPTION OF THE DRAWINGS

The foregoing and/or other objects, features and advantages of the invention will become more apparent from the following description of a preferred embodiment with reference to the accompanying drawings in which like reference numerals designate like elements and wherein:

FIGS. 10A and 10B are enlarged views of essential parts of the mattress shown in FIG. 1 in a longitudinal section, wherein FIG. 10A shows a non-working state of a body pressure, and FIG. 10B shows a working state of the local body pressure.

DETAILED DESCRIPTION OF PREFERRED EMBODIMENTS

Figure 1:
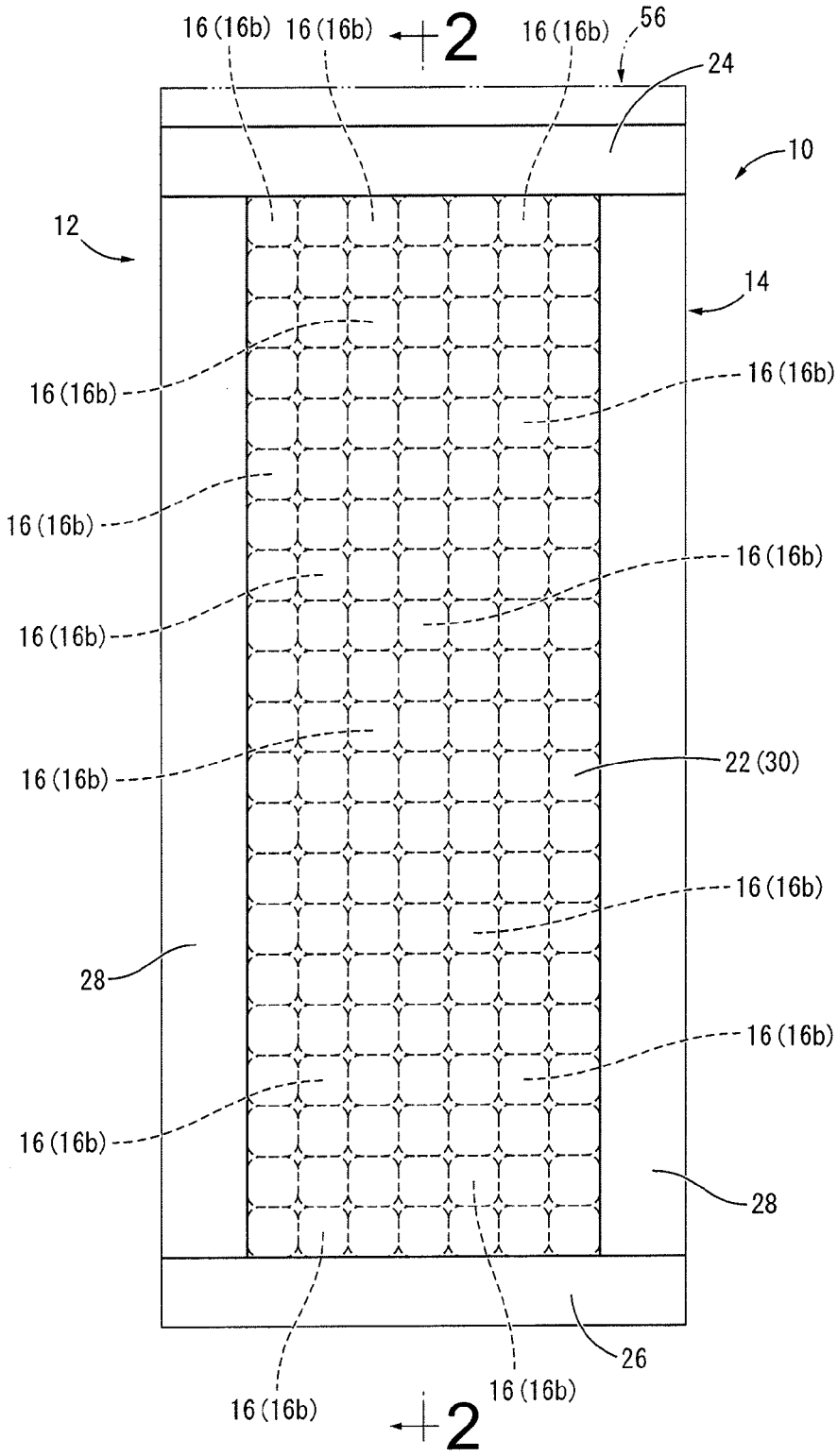
FIG. 1 is a plan showing a mattress as one of the embodiments of the present invention.
Figure 2:
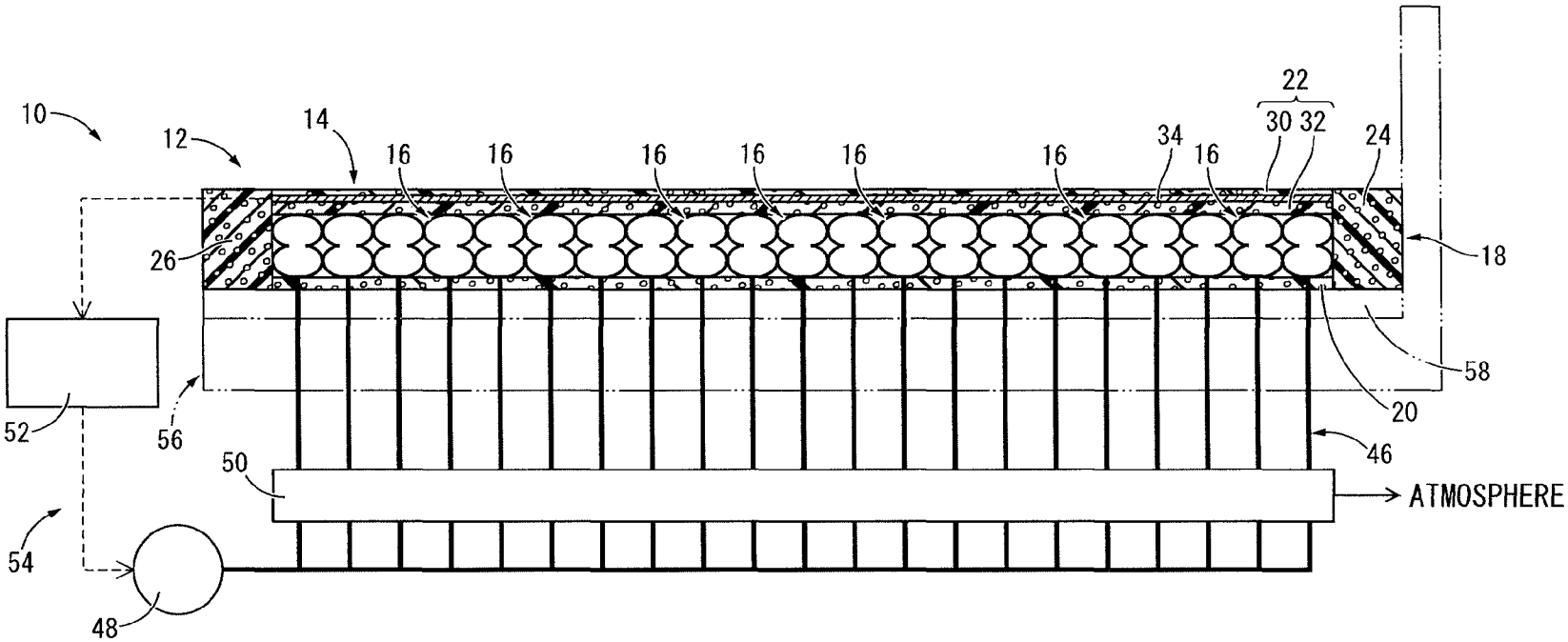
FIG. 2 is a cross-section 2-2 of FIG. 1.

FIGS. 1 and 2 show a mattress 10 as one of the embodiments of the present invention. The mattress 10 comprises a mattress main body 12, which in turn comprises a box-like housing 14 and a plurality of cells 16 contained in the housing 14. In the following descriptions, the word "up and down direction" generally means an up and down direction in FIG. 2, which is a vertical direction therein.

More specifically, the housing 14 is formed entirely with an elastic cushion material, and a bottom mat 20 is embedded as a substrate in the lower opening of a framework 18, while a top mat 22 as a cushion layer is embedded in the upper opening of the framework 18.

The framework 18 is an elastic member formed entirely with porous urethane foam and structured with a head side block 24 and a foot side block 26 arranged parallel to each other that are connected by a pair of side blocks 28 and 28 in a shape of a rectangular framework viewed in the up and down direction. The material making up the framework 18 is not particularly limited, nor is it limited to any foamed material, but should preferably be elastic materials such as urethane foam, considering the contact with human body and the followability to deformation during head-up tilting of the bed, which will be described later.

The bottom mat 20 is a member in a shape of a rectangular plate made thinner than the framework 18 in the up and down direction, and is formed with porous urethane foam in the present embodiment. The bottom mat 20 also corresponds to the opening of the framework 18 in its shape viewed in the up and down direction, and is embedded in the lower opening of the framework 18.

The top mat 22 is a member in a shape of a rectangular plate thicker than the bottom mat 20, and is structured in two layers having a surface portion 30 as a first cushion layer and a back portion 32 as a second cushion layer, each formed with porous urethane foam. Also, the top mat 22 is made in an approximately the same shape as the bottom mat 20 viewed in the up and down direction, and is embedded in the upper opening of the framework 18. The surface portion 30 and the back portion 32 can be formed with the same material, but better sleeping comfort can be achieved by forming them of materials with different elastic moduli and so forth.

The top mat 22 is provided with a body pressure sensor 34. The body pressure sensor 34, made of a soft sheet, is arranged to be tucked between the surface portion 30 and the back portion 32 of the top mat 22, and these surface portion 30, body pressure sensor 34 and back portion 32 are stuck on top of each other. The specific structure of the body pressure sensor 34 is not particularly limited, but the capacitance type sensor in a sheet form as shown in Japanese Unexamined Patent Application Publication No. JP-A-2011-75322 is preferably adopted. In other words, a soft belt-like first electrode film is arranged on one side of a dielectric layer formed with rubber elastic body and the like, and a second electrode film in a similar shape to the first electrode film with a different longitudinal direction is arranged on the other side, while a detection unit is configured at a portion where the first and second electrode films are facing with each other. Then, when an external force such as the body pressure (body weight load) is applied to the detection unit, the dielectric layer changes its thickness (distance between the first and second electrode films) and the capacitor configured in the detection unit changes its capacitance so as to detect the body pressure exerted on the detection unit based on the changes in the capacitance. The body pressure sensor 34 is preferably thin and flexible in order not to affect the sleeping comfort. However, as the body pressure sensor 34, it is also possible to adopt a load cell using a strain gauge or a magneto-striction body other than the capacitance type sensor.

According to the Japanese Unexamined Patent Application Publication No. JP-A-2011-75322, the loads at 256 locations can be measured by detection units arranged in 16 columns and 16 rows, but in the present embodiment, the number of detection units of the body pressure sensor 34 is set according to the number of cells 16 described later, and the loads at 147 locations are considered to be measurable by the detector units arranged in 21 columns and 7 rows. The number of detection units of this body pressure sensor 34 is not necessarily limited to the same as that of the cells 16, but more detection units can be installed than the number of cells 16 to detect the body load with higher precision.

The housing 14 with such a structure contains a plurality of cells 16 arranged therein. As shown in FIGS. 3 to 7, each cell 16 is made like bags or balloons in a shape of a rectangle with its corners rounded in arc (rounded rectangle) in the planar view (in the height direction view), and is structured as a combination of an upper bag portion 36 and a lower bag portion 38. More specifically, the upper bag portion 36 is in an approximate shape of a reverse sack opening up downward, while the lower bag portion 38 is in an approximate shape of a sack opening up upward, and the opening of the upper bag portion 36 and the opening of the lower bag portion 38 are bonded to each other to form the cell 16. In the present embodiment, the cell 16 has the same longitudinal and lateral dimensions, but either dimension can be longer than the other.

Also, a fluid chamber 40 is formed within the cell 16. The fluid chamber 40 is formed by having the interior space of the upper bag portion 36 and the lower bag portion 38 communicated with each other through a communicating portion 41 that uses the openings of the upper bag portion 36 and the lower bag portion 38. The fluid chamber 40 is generally closed to the outside and communicated therewith via a port 42 in a cylindrical shape that penetrates through the bottom of the cell 16. Then, the pressure of the fluid chamber 40 is controlled by supplying and draining fluid such as air to and from the fluid chamber 40 via the port 42 so that the cell 16 switches between an expanded state shown in FIGS. 3 to 5 and a contracted state shown in FIGS. 6 and 7, or any other intermediate state in between.

Figure 5:
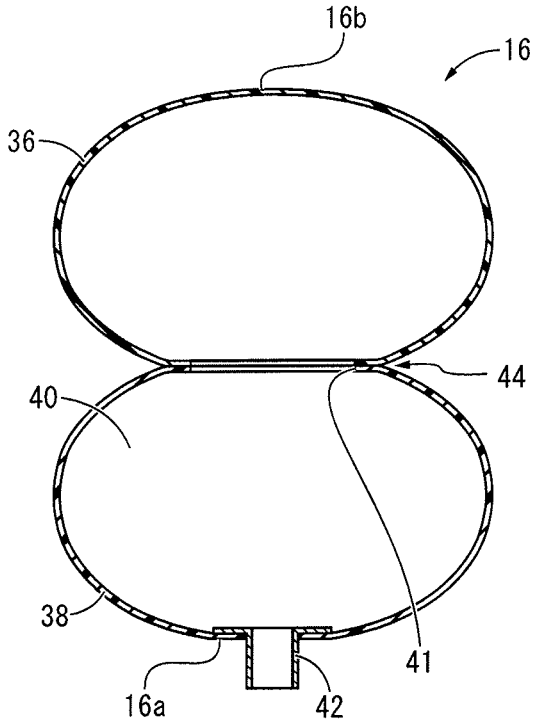
FIG. 5 is a cross-section 5-5 of FIG. 4.
Figure 7:
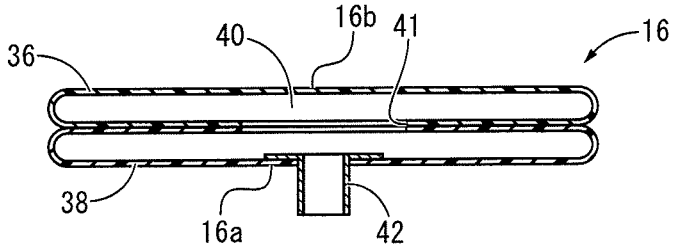
FIG. 7 is a cross-section 7-7 of FIG. 6.

As evident from FIGS. 5 and 7, the cell 16 in an expanded state has a larger height as well as smaller lateral and longitudinal dimensions (projected area viewed in the height direction) than the cell 16 in a contracted state. Also, the inner pressure of the cell 16 is not set solely at the maximum expansion state shown in FIG. 5 or the maximum contraction state shown in FIG. 7, but is also set somewhere between the maximum expansion and the maximum contraction either continuously or in steps. Furthermore, the fluid supplied to or drained from the cell 16 is not limited to air, but a liquid such as water, for example, can be used.

Figure 8:
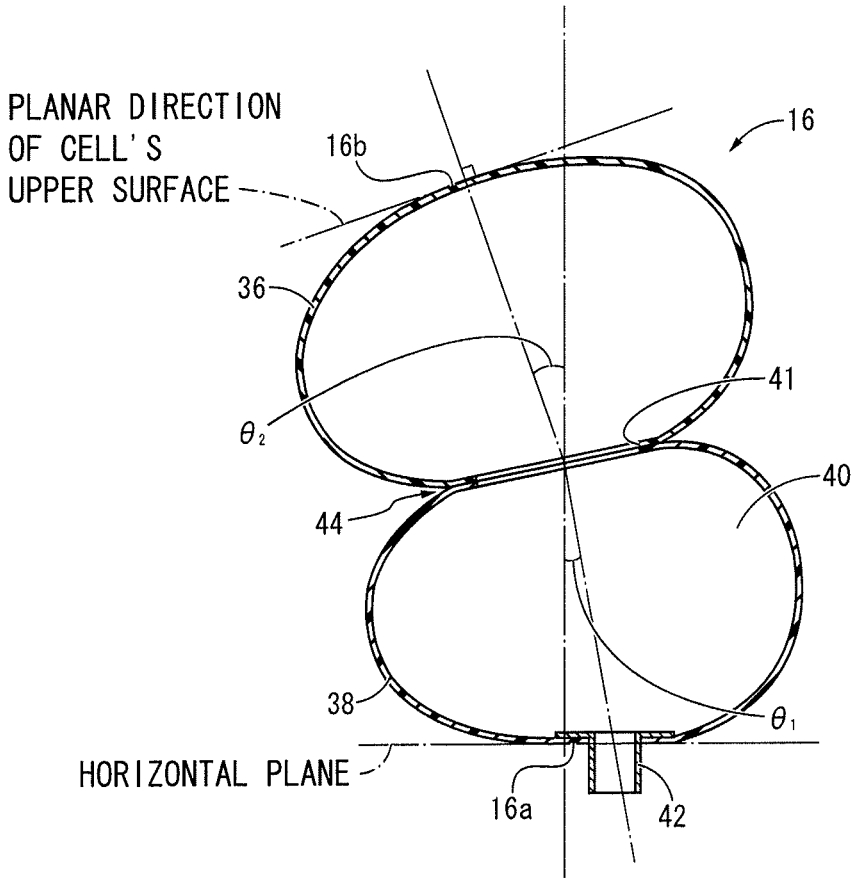
FIG. 8 is a longitudinal section of the cells shown in FIG. 3 in a state of deformation.

Also, in the middle in the height direction of the cell 16, a constricted portion 44 is formed. That is, the constricted portion 44 is formed at the location where the upper bag portion 36 and the lower bag portion 38 are bonded to each other (at the opening) by having the upper bag portion 36 and the lower bag portion 38 comprising the cell 16 each configured to gradually narrow down toward the opening. This allows the cell 16 to get thin in the middle in the height direction where the constricted portion 44 is provided to create a two-tier structure in an approximate shape of FIG. 8 or a gourd fruit in a longitudinal section in an expanded state. In the present embodiment, the cross-section of the constricted portion 44 is made to be approximately similar to those of the upper bag portion 36 and the lower bag portion 38.

Figure 9:
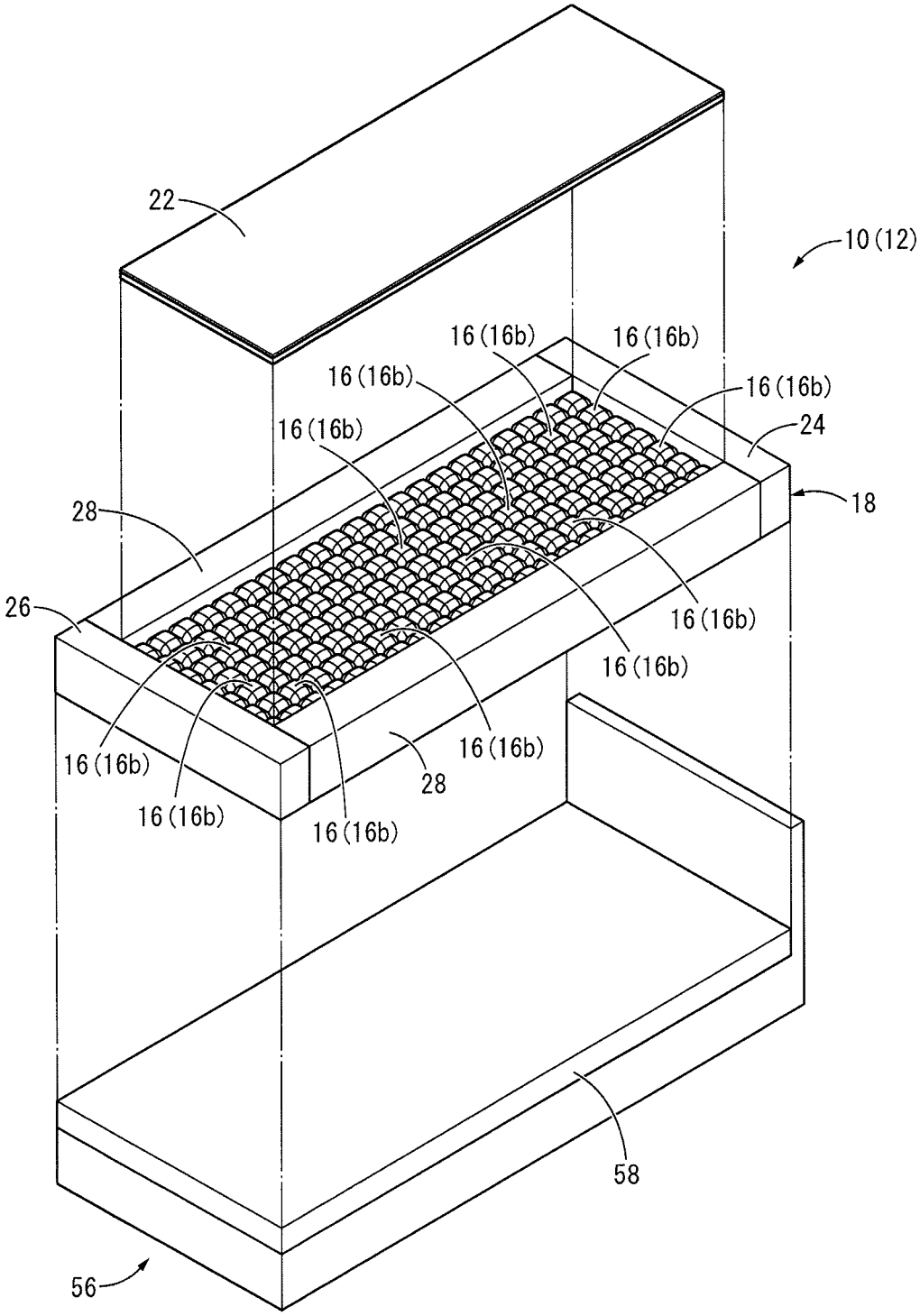
FIG. 9 is an axonometric view showing an assembly of the mattress of FIG. 1 and a bed that supports it.

The cell 16 structured as above is contained in plurality in the housing 14 as shown in FIG. 9. In other words, in the inner side of the framework 18, a plurality of cells 16 are arranged almost side by side on the upper surface of the bottom mat 20, and a bottom surface 16*a* of each cell 16 is bonded to the bottom mat 20 at the center (around the port 42) to have each cell 16 supported by the bottom mat 20 in a tilt-movable manner. In addition, on the upper surface 16*b* of the cell 16, the top mat 22 is overlapped without bonding to be fitted in the upper opening of the framework 18. In the present embodiment, 147 of the cells 16 are arranged in 21 columns and 7 rows as shown in FIG. 1.

Although not shown in FIG. 2, the port 42 of each cell 16 is arranged in penetration through the bottom mat 20. The port 42 can be placed on top of the bottom mat 20 without penetrating through it, in which case, a supply and drainage path 46 described later, for example, can be arranged in penetration through the bottom mat 20 or placed on top of the bottom mat 20 to be connected to the port 42.

Furthermore, the port 42 is connected to each supply and drainage path 46 outside the housing 14 so that the fluid chamber 40 of the cell 16 can be communicated selectively either with a pump 48 or the atmosphere via the supply and drainage path 46. The fluid chamber 40's connection to the pump 48 or opening to the atmosphere can be switched between the two by a valve means 50 such as a three-way valve provided on the supply and drainage path 46. Also, the fluid chamber 40 of each cell 16 is substantially independent from each other so that air does not flow between the cells 16. Such an independence of the fluid chamber 40 is achieved by giving independence to the supply and drainage path 46 per each cell 16.

Figure 3:
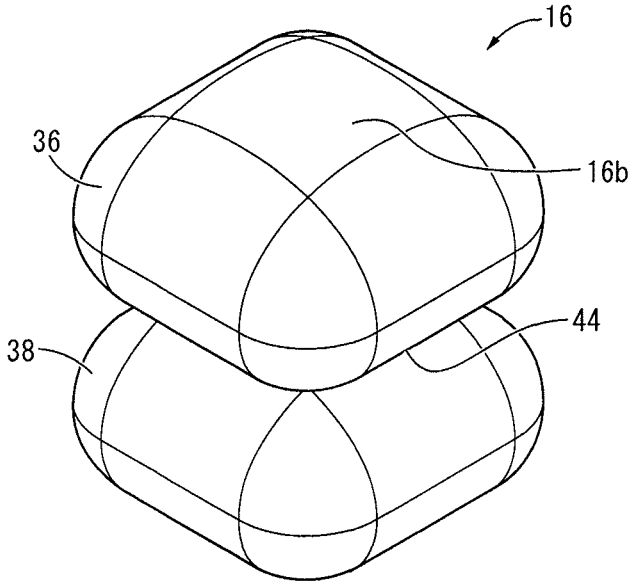
FIG. 3 is an axonometric view showing cells that make up the mattress shown in FIG. 1.
Figure 4:
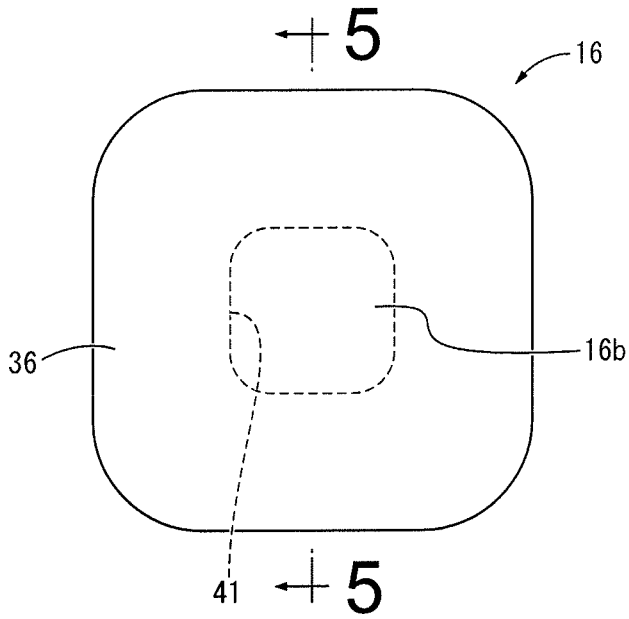
FIG. 4 is a plan of the cells shown in FIG. 3.

Then, the pressure in the fluid chamber 40 is heightened by the connection between the fluid chamber 40 and the pump 48 that supplies air to the fluid chamber 40 so that the cell 16 is brought to an expanded state shown in FIGS. 3 to 5. On the other hand, the pressure in the fluid chamber 40 is lowered to bring the cell 16 to a contracted state shown in FIGS. 6 and 7 by means of having the fluid chamber 40 open to the atmosphere to release the air in the fluid chamber 40 to the atmosphere. As evident from FIGS. 5 and 7, this allows the height dimension in the vertical direction to change by controlling the pressure in the fluid chamber 40. Other than the valve means 50 described above, the means for controlling the pressure in the fluid chamber 40 can be achieved by connecting the fluid chamber 40 and the pump 48 all the time and by controlling the operation of the pump 48 through the adoption of a pump, as the pump 48, that is switchable between air intake and exhaust operations.

In addition, the pump 48 and the valve means 50 are controlled by a control means 52. The control means 52 controls the flow rate of the pump 48 and switching of the valve means 50 and the like by generating control signals based on detection signals inputted from the body pressure sensor 34 of the top mat 22 and inputting them to the pump 48 and the valve means 50. In the present embodiment, since the air pressure in each of the plurality of cells can be set differently, a pump that is capable of differentiating the flow rate for each cell 16 can be adopted, or the air pressure can be set individually by adjusting the switching timing of the valve means 50 for each cell 16. As evident from the above, a pressure control means 54 for changing the setting individually about the heights of the cells 16 by adjusting the pressure in each fluid chamber 40 comprises the body pressure sensor 34, supply and drainage path 46, pump 48, valve means 50 and control means 52.

Also, when a force in the planar direction (left-right direction in FIG. 5) is applied to the upper surface 16*b* of the cell 16 arranged on the bottom mat 20 in an expanded state (including intermediate states), the upper bag portion 36 is subjected to precession-deformation (precession tilt) against the lower bag portion 38. In other words, the upper bag portion 36 is allowed to tilt in a precession manner against the lower bag portion 38 centered around the constricted portion 44 by providing the constricted portion 44 made thinner than other portions at the border between the upper bag portion 36 and the lower bag portion 38 of the cell 16. Thus, the precession tilt of the cell 16 at the constricted portion 44 allows the upper surface 16*b* (top surface of the upper bag portion 36) of the cell 16 extending near horizontally in a still standing state to tilt from the horizontal plane.

In addition, the cell 16 is supported by the bottom mat 20 only at the center portion where the port 42 is provided, and the lower bag portion 38 is allowed to tilt centered around the port 42 at the center of the bottom surface 16*a* by virtue of the deformation of the lower bag portion 38 and the bottom mat 20. This makes the tilt angle $\theta_2$ allowed for the upper surface 16*a* of the cell 16 to be the sum of the allowed tilt angle of the upper bag portion 36 against the lower bag portion 38 and the allowed tilt angle $\theta_1$ of the lower bag portion 38 against the bottom mat 20. For example, by having the center portion of a soft substrate for attachment fixed to the center of the bottom surface 16*a* of the cell 16 and by having the outer periphery thereof attached to the bottom mat 20 at multiple locations or all around the circumference, the cell 16 can be substantially supported by the bottom surface 16*a* at its center via the substrate. In this case, the tilt around the center of the bottom surface 16*a* of the cell 16 is allowed by the deformation of the substrate in addition to the deformation of the cell 16.

Thus, the cell 16 is made to tilt its upper surface 16*b* at a large angle by having the constricted portion 44 in the middle in the height direction and by having only the center portion of the bottom surface 16*a* supported by the bottom mat 20. The cell 16 is made to tilt in any direction as long as it is in a radial direction around the central axis in a still standing state.

As shown in FIG. 9, the mattress 10 with such a structure has the mattress main body 12 overlapped on a body support portion 58 of a bed 56. Then, when the user lies down on the mattress 10, he is supported by the body support portion 58 of the bed 56 as his body pressure is applied on the top mat 22, the plurality of cells 16, and the bottom mat 20. Also, the supply and drainage path 46, pump 48, valve means 50 and control means 52 are arranged in the storage space provided within, or below the body support portion 58 of the bed 56, or elsewhere. Since the body weight (body pressure) based on the gravity acting on the user works downward, each of the upper surfaces of the top mat 22, cell 16, bottom mat 20, and body support portion 58 is called a body pressure working surface.

The mattress 10 of the present embodiment with such a structure is capable of preventing the reaction force against the body pressure exerted by the mattress main body 12 on the user from increasing locally when the user lies down on the top mat 22.

More specifically, air is first sent from the pump 48 to the fluid chamber 40 of each cell 16 before the user lies down on the top mat 22 so as to maximize the height of the cell 16. This prevents the cell 16 from bottoming when the user lies down, thus supporting the user with enough shock absorbing ability.

Also, as the body weight of the user who lies down on the top mat 22 is placed on the body pressure sensor 34 of the top mat 22, the body pressure sensor 34 detects the body pressure distribution based on the contour of the user's body surface, results of which are outputted to the control means 52 as detection signals. The body pressure sensor 34 is made to be capable of individually detecting the magnitude of the (body) pressure acting on each cell 16, and in the present embodiment, the body pressure sensor 34 is made to receive detection signals from each of 147 of the cells 16.

Also, the control means 52 outputs control signals to the pump 48 and the valve means 50 based on the detection signals sent from the body pressure sensor 34. Then, the pressure in the fluid chamber 40 is adjusted to change the setting of the height of the cell 16 by controlling the flow rate of the pump 48 and the selective connection of the fluid chamber 40 either to the pump 48 or to the atmosphere using the valve means 50.

More specifically, in each cell 16 subjected to large body pressure, the pressure in the fluid chamber 40 is adjusted low to decrease the height of the cell 16, while in each cell 16 subjected to small body pressure, the pressure in the fluid chamber 40 is adjusted high to increase the height of the cell 16. This allows the height of the cell 16 to be adjusted to follow the contour of the body surface, and prevents the body pressure from acting locally, resulting in the dispersion of the body pressure.

Figure 10A:
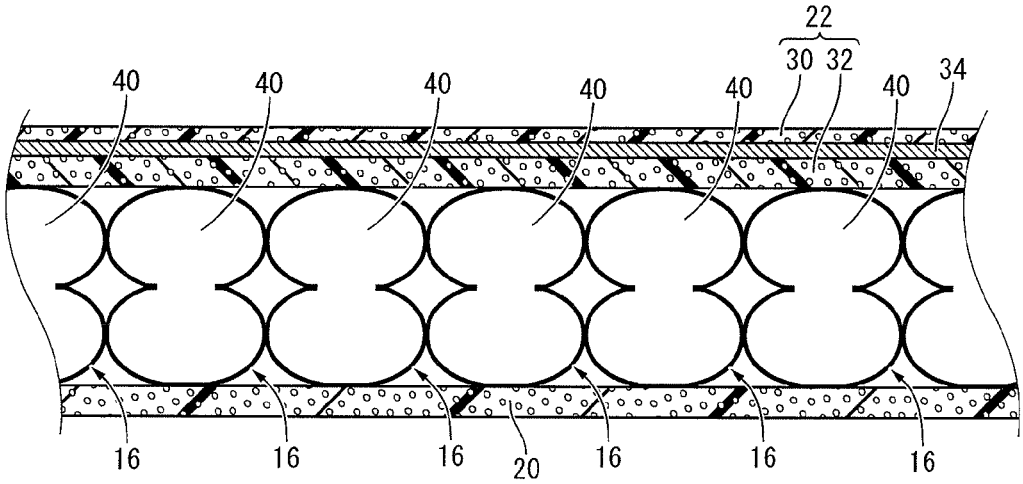
Figure 10B:
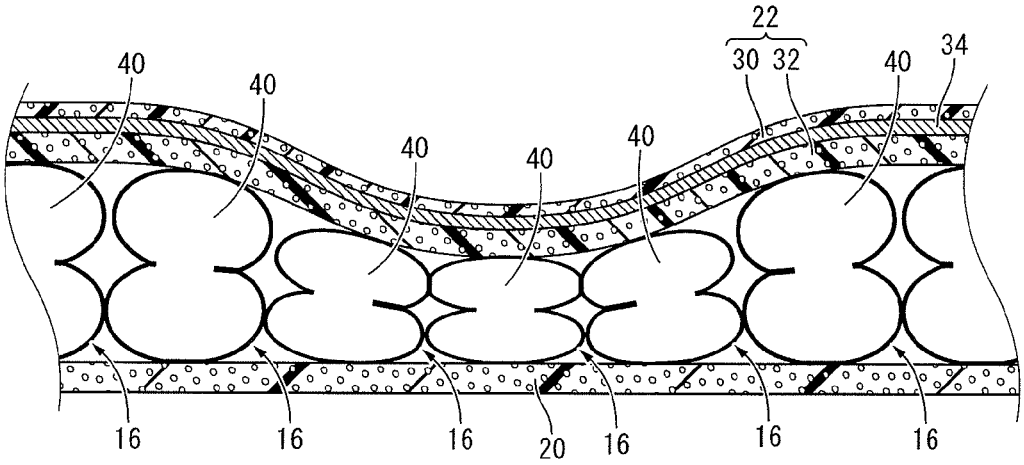

Moreover, as to the mattress 10, its surface follows the contour of the human body in a curvy and smooth shape by the tilting of the upper surface 16*b* of the cell 16. In other words, when the user lies on the mattress 10 standing still (FIG. 10A), the top mat 22 is subjected to curvature (depression) deformation due to the user's body weight, as shown in FIG. 10B, to displace itself as if it is drawn to the lowest point. At that time, the cell 16 that supports the curving portion of the top mat 22 has the upper part of the constricted portion 44 (upper bag portion 36) get tilted (undergo precession tilt) relative to the lower part (lower bag portion 38) based on the frictions and so forth acting against the top mat 22. Then, the upper surface 16*b* of the cell 16 (body pressure working surface) is tilted following the deformation (displacement) of the top mat 22 due to the precession tilt of the cell 16 around the constricted portion 44 as described above. This allows the supporting surface in a shape following the contour of the top mat 22 to be composed of the upper surface 16*b* of the plurality of cells 16 to make the surface of the mattress 10 deformable to the shape following the human body contour. The port 42 and the supply and drainage path 46 are omitted in FIGS. 10A and 10B.

Thus, the upper surface 16*b* (body pressure working surface) of the cell 16 gets in contact with the user's body surface over a wider area by tilting itself in accordance with the user's body contour, thus achieving the dispersion of body pressure. This prevents local pressure from being applied too much on the user's body and inhibits the generation of bedsores.

In addition, the cell 16 not only has the upper bag portion 36 allowed to undergo precession tilt relative to the lower bag portion 38 due to the constricted portion 44, but also has the lower bag portion 38 allowed to tilt at a given angle $\theta_1$ against the bottom mat 20. Therefore, the upper surface 16*b* of the cell 16 is allowed to tilt at an angle $\theta_2$, which is larger by $\theta_1$ than that of the precession tilt only at the constricted portion 44. This enhances the followability of the cell 16 to the depression deformation of the top mat 22, which efficiently disperses the body pressure to prevent bedsores.

Figure 6:
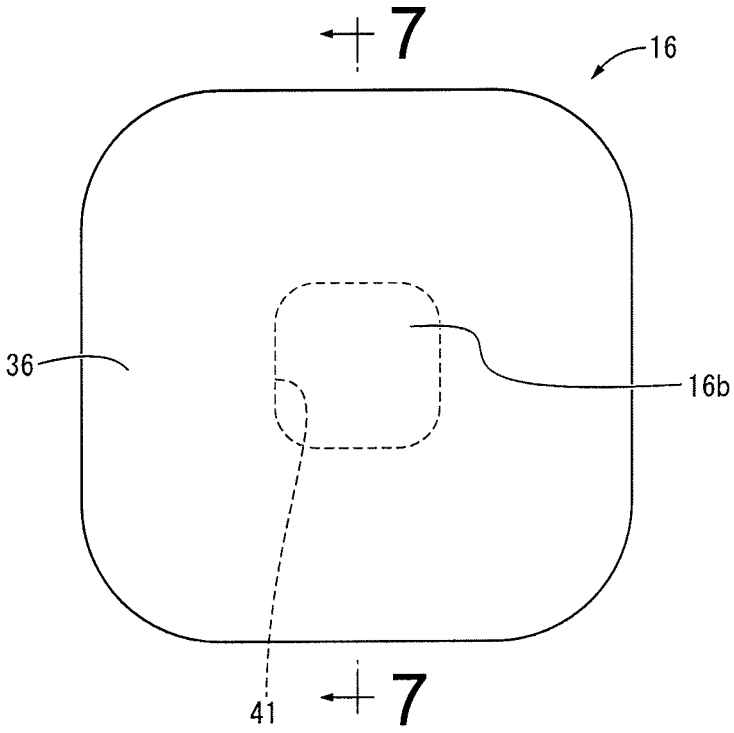
FIG. 6 is a plan of the cells shown in FIG. 3 in a contracted state.

Also, each cell 16 is made in a shape of a rounded rectangle in a planar view (see FIGS. 4 and 6). This ensures a large area of the upper surface 16*b* of the cell 16 to effectively exert the action of dispersing the body pressure, while preventing damages to the cell 16 caused by concentrated pressure on the corners by means of rounding them off, thus improving the durability.

Furthermore, since the inner pressure of the cell 16 is set low in the area where the user's body pressure is applied hard, it is easier for the upper surface 16*b* of the cell 16 to deform its configuration following the user's body surface. Therefore, the area of contact between the upper surface 16*b* of the cell 16 and the user's body is maintained large enough to effectively disperse the body pressure, thus providing an excellent sleeping comfort.

Also, since the height of each cell 16 is made to be individually adjustable by the pressure control means 54, the upper surface 16*b* of the cell 16 can be made to follow the top mat 22 in high precision by changing the height of the cell 16 in steps in accordance with the depression deformation of the top mat 22 and by having the cell 16 get tilted. Therefore, the body pressure can be favorably dispersed to avoid the problems such as bedsores.

Furthermore, since the air flow is blocked between each cell 16, the air does not flow from one cell 16 to another even if it is pressed hard. Therefore, the unstable feeling on the upper surface of the mattress main body 12 is eliminated to improve the sleeping comfort with reduced feeling of sea sickness.

Moreover, the plurality of cells 16 are arranged to stand on the bottom mat 20 without interfering with each other in a horizontal direction. Therefore, when the user slides (moves in a planar direction) his body on the top mat 22, the cell 16 gets deformed in such a way that the upper surface 16*b* and the bottom surface 16*a* are shifted from each other, thus allowing sliding displacement of the top mat 22 in accordance with the user's movement. This restricts any friction between the user's body and the top mat 22, thus preventing bedsores caused thereby.

Additionally, since the height of the cell 16 is controlled based on the distribution of the user's body pressure detected by the body pressure sensor 34, the body pressure is dispersed almost evenly by the height adjustment of the cell 16. Therefore, it is now possible to effectively prevent bedsores caused by concentrated body pressure from developing.

Besides, a flexible structure is adopted as the body pressure sensor 34, and at the same time, the body pressure sensor 34 is sandwiched between the surface portion 30 and the back portion 32. Therefore, the body pressure does not get concentrated due to the arrangement of the body pressure sensor 34, thus avoiding any adverse effect on sleeping.

Also, the top mat 22 is evenly supported by the cell 16 at an almost constant interval by having the upper surface 16*b* of the cell 16 tilt following the deformation of the top mat 22. This allows the user's body to be supported stably by the cell 16 over a wide area, thus offering a good sleeping comfort.

Also, since the user's body does not get caught between the plurality of cells 16 due to the interposition of the top mat 22 between the cell 16 and the user's body, the user's body is supported stably by the continuous surface of the top mat 22. Therefore, by alleviating the unstable feeling on the mattress 10 while enhancing the followability to the human body contour by adopting the cells 16 made to tilt independently from each other, nausea and vomiting arising from the feeling of sea sickness can be prevented, and the sleeping comfort is improved.

Also, the cell 16 is prevented from falling down outward by having the plurality of cells 16 arranged on the inner side of the framework 18. This allows each cell 16 to be aligned approximately in the up and down direction to achieve stable dispersion of body pressure by height adjustments. In addition, since the entire framework 18 is made of a flexible material such as urethane foam, damages in the incidents where users hit their body parts (e.g. arms and legs) against the framework 18 can be avoided, and thus the safety of the bed is assured.

The bed 56 that supports the mattress main body 12 can also comprise a means for head-up adjustment that bends the mattress main body 12 where the portion supporting the user's upper body is tilted against the other portion supporting the lower body. The head-up adjustment means is the one provided in a regular nursing care bed wherein the upper body support part of the body support portion 58 and the frame of the bed 56 are connected by an expandable support rod, for example, so that the upper body support portion of the body support portion 58 can be tilted against the frame of the bed 56 as the support rod expands and contracts by the power of a hydraulic or electric motor and the like. However, the head-up adjustment means is not limited to the above structure, but can also be adopted in such a way that the body support portion 58 is divided into upper and lower body support portions with a motor-driving unit provided in between, and the upper body support portion gets tilted against the lower body support portion by the power of the electric motor. Various aspects of the head-up adjustment means can be adopted including a motorized one that bends the body support portion 58 and a manual one that bends the same by hand.

In the present embodiment, the entire housing 14 that constitutes the mattress main body 12 is made of urethane foam and allowed to undergo elastic deformation. Therefore, when the mattress main body 12 is arranged on the bed 56 provided with the head-up adjustment means, the flexible housing 14 does not interfere with the flexural deformation of the mattress main body 12 due to the head-up tilting, thus fully allowing the head-up adjustment.

Embodiments of the present invention have been described in detail above, but the present invention is not limited by those specific descriptions. For example, in one of the above embodiments, the cell 16 was made in a shape of a rounded rectangle in a planar view in order to avoid concentration of inner pressure while keeping the support area wide enough, but any other shape in a planar view can be adopted for the cell such as a circle, various polygons with or without rounded corners, and other irregular shapes.

Also, the shape of the cell 16 in a planar view does not have to be similar to that of the constricted portion 44 (communicating portion 41), and a cell in a shape of a rounded rectangle, for example, can be provided with a constricted portion (communicating portion) in a circular shape.

Figure 11:
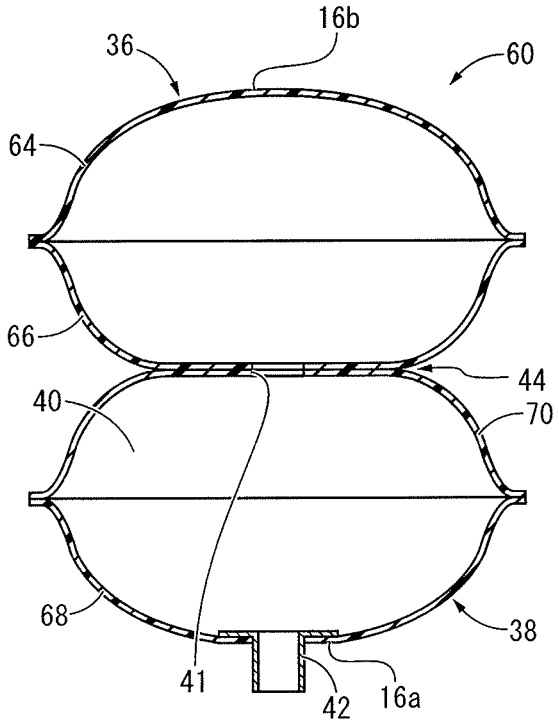
FIG. 11 is a longitudinal section showing cells used for a mattress as another embodiment of the present invention.

Also, the cell 16 was structured to have the upper bag portion 36 and the lower bag portion 38 bonded to each other at the opening, but the cell structure is not limited to the particular one, but can be formed like the cell 60 shown in FIG. 11 where four sheets are welded to each other. In other words, the cell 60 has the upper bag portion 36 formed by welding a top portion 64 in a shape of a rounded rectangle sheet and an upper intermediate part 66 in a shape of a rounded rectangle with a through-hole made in its center to each other along the outer periphery. Further, the lower bag portion 38 is formed by welding a bottom portion 68 in a shape of a rounded rectangle sheet with the port 42 attached to the center and a lower intermediate part 70 in a shape of a rounded rectangle with a through-hole made in the center to each other. Then, the cell 60 is formed by welding the upper intermediate part 66 and the lower intermediate part 70 to each other along the inner periphery. In producing the cell 60, the top portion 64 and the bottom portion 68 can be welded to the upper and lower intermediate parts 66 and 70 after welding the upper intermediate part 66 and the lower intermediate part 70 along the inner periphery. In addition, it is also possible to obtain the targeted cell by forming a bag portion in a shape of a void sphere or column and binding the intermediate part of the bag portion in the height direction with a ring wire and so forth to form the constricted portion 44.

Also, in the embodiment described above, the cell 16 is made to be a two-tier structure having the upper bag portion 36 and the lower bag portion 38 with only one constricted portion 44, but the cell can be a three or more tiered structure, in which case two or more constricted portions 44 can be formed.

Also, the arrangement and number of the cell 16 are not limited to particular ones. More specifically, cells in a diamond shape in a planar view, for example, can be arranged side by side in a diagonal direction. In this case, as in the embodiment described above, the arrangement and number of the detection unit of the body pressure sensors 34 can be set according to the arrangement and number of the cells, or the number of the body pressure sensors 34 can be more than that of the cells.

Also, in the embodiment described above, the top mat 22 was overlapped on the upper surface 16*b* of the cell 16 in an unbonded manner, but the upper surface 16*b* of the cell 16 can be fixed to the bottom surface of the top mat 22 by means of adhesion and the like. According to this method, offset positioning of the support of top mat 22 by the cell 16 can be prevented while allowing enough deformation of the top mat 22 due to the tilting of the cell 16, thus providing a stable support of the user's body.

Also, the substrate, framework or cushion layer does not have to be made of urethane foam. In addition, the cushion layer is made of an elastic material, but is not limited to foamed materials and can be made of a non-foaming elastic body or a three-dimensional knit material and so forth.

Also, the location where the body pressure sensor 34 is arranged is not limited to any particular area as long as the user's body weight can be measured. For example, the body pressure sensor 34 can be arranged in between the two-tier bottom mat, or arranged to overlap on the bottom surface of the bottom mat 20. Needless to say, the top mat 22 can be made in a single-tier when the body pressure sensor 34 is located elsewhere other than in the top mat 22.

Also, the control method of the cell 16 described in the above embodiment is just an example, and the inner pressure control of the cell 16 is not intended solely for dispersion of the body pressure. For example, when the user turns over in bed, the sinking of the bed is restricted by heightening the inner pressure of the cell 16 to harden the mattress main body 12 so as to make it easier for the user to turn over in sleep. In addition, it is possible to proactively assist the user to turn over in sleep by means of adjusting the height of the cell 16 and tilting the upper surface of the mattress main body 12 in order to lower the height in the direction the user turns over to. Also, it is conceivable to assist the user in leaving or entering the bed by adjusting the hardness and surface configuration of the mattress main body 12.

Also, in the embodiment described above, the initial setting was made to maximize the height of each cell 16 before the user lies down on the mattress main body 12, but the cell 16 can be set initially after the user lies down by means of adjusting the inner pressure of the cell 16 with the user lying in bed, or the initial setting can be done after the user changes his body position (after turning over etc.). The initial setting of the cell 16 is not necessarily limited to maximizing each cell height, but can also be adjusted to any prescribed height for each cell 16.

What is claimed is:

1. A mattress comprising:

a plurality of cells arranged on a body pressure working surface of a substrate that supports a human body;

a pressure control means that changes a setting of a height of each cell by adjusting a pressure in a fluid chamber formed within the cell;

an elastic cushion layer provided on a body pressure working surface of the cells; and a constricted portion formed in a middle in the height of the each cell and an upper part of the constricted portion of the cell is tiltable relative to a lower part of the constricted portion of the cell so that the body pressure working surface of the cell is configured to be tilted following deformation of the cushion layer.

2. The mattress according to claim 1, wherein a bottom center portion of the cells are supported by the substrate and the cells are allowed to tilt against the substrate.

3. The mattress according to claim 1, wherein the pressure control means is able to change the setting individually about the heights of the plurality of cells.

4. The mattress according to claim 1, wherein each of the cells has a rectangular shape with rounded corners as seen in a height direction projection.

5. The mattress according to claim 1, wherein an elastic framework is provided and the plurality of cells are arranged inside the framework.

6. A mattress comprising:

a plurality of cells arranged on a body pressure working surface of a substrate that supports a human body;

a pressure control means that changes a setting of a height of each cell by adjusting pressure in a fluid chamber formed within the cell;

an elastic cushion layer provided on a body pressure working surface of the cells; and a constricted portion formed in a middle in the height of the each cell so that the body pressure working surface of the cell is configured to be tilted following deformation of the cushion layer as a result of the cells' precession-deformation at the constricted portion, wherein the cushion layer is structured in two layers, which is a first cushion layer and a second cushion layer stuck together, and a body pressure sensor for measuring body weight is arranged between the first and second cushion layers.

7. A mattress comprising:

a plurality of cells arranged on a body pressure working surface of a substrate that supports a human body;

a pressure controller that changes a setting of a height of each cell by adjusting a pressure in a fluid chamber formed within the cell;

an elastic cushion layer provided on a body pressure working surface of the cells; and a constricted portion formed in a middle in the height of the each cell and an upper part of the constricted portion of the cell is tiltable relative to a lower part of the constricted portion of the cell so that the body pressure working surface of the cell is configured to be tilted following deformation of the cushion layer.

8. The mattress according to claim 7, wherein a bottom center portion of the cells are supported by the substrate and the cells are allowed to tilt against the substrate.

9. The mattress according to claim 7, wherein the pressure controller is able to change the setting individually about the heights of the plurality of cells.

10. The mattress according to claim 7, wherein each of the cells has a rectangular shape with rounded corners as seen in a height direction projection.

11. The mattress according to claim 7, wherein an elastic framework is provided and the plurality of cells are arranged inside the framework.

12. The mattress according to claim 7, wherein the cushion layer is structured in two layers, which is a first cushion layer and a second cushion layer stuck together, and a body pressure sensor that measures body weight is arranged between the first and second cushion layers.

* * * * *

UNITED STATES PATENT AND TRADEMARK OFFICE

CERTIFICATE OF CORRECTION

PATENT NO. : 8,745,797 B2
APPLICATION NO. : 13/910470
DATED : June 10, 2014
INVENTOR(S) : A. Misaki et al.

It is certified that error appears in the above-identified patent and that said Letters Patent is hereby corrected as shown below:

On the Title Page, Page 1, under (72) Inventors, "Shuji Fukugawa, Fukuoka (JP)" should read --Shuji Fukagawa, Fukuoka (JP)--.

Signed and Sealed this
Eleventh Day of November, 2014

Michelle K. Lee

Michelle K. Lee
*Deputy Director of the United States Patent and Trademark Office*